US006189187B1

(12) United States Patent
Williams

(10) Patent No.: US 6,189,187 B1
(45) Date of Patent: Feb. 20, 2001

(54) CLIP FOR HOLDING A PAIR OF ELONGATED MEMBER PORTIONS

(76) Inventor: John J. Williams, 69200 E. 188 Rd., Wyandotte, OK (US) 74370

( * ) Notice: Under 35 U.S.C. 154(b), the term of this patent shall be extended for 0 days.

(21) Appl. No.: 09/405,784

(22) Filed: Sep. 27, 1999

(51) Int. Cl.[7] ..... A44B 21/00; B65D 63/00

(52) U.S. Cl. ..... 24/563; 24/16 R; 24/30.5 S; 24/17 AP; 24/336; 24/545

(58) Field of Search ..... 24/563, 545, 552, 24/336, 370, 30.5 S, 17 AP, 17 B, 16 R

(56) References Cited

U.S. PATENT DOCUMENTS

| | | | | |
|---|---|---|---|---|
| 479,509 | | 7/1892 | Heaphy, Jr. . | |
| 698,287 | * | 4/1902 | Johnson | 24/563 |
| 1,478,896 | * | 12/1923 | Ferency | 24/563 |
| 1,719,766 | | 7/1929 | Hopkins . | |
| 2,064,591 | * | 12/1936 | David | 24/563 |
| 2,292,140 | | 8/1942 | Lofgren . | |
| 2,533,341 | | 12/1950 | Alfano . | |
| 2,981,990 | * | 5/1961 | Balderree, Jr. | 24/30.5 S |
| 2,984,442 | * | 5/1961 | Lawson | 24/563 |
| 3,050,803 | | 8/1962 | Hulterstrum . | |
| 3,141,359 | | 7/1964 | Bennett et al. . | |
| 3,171,179 | * | 3/1965 | Lee | 24/336 |
| 4,414,711 | | 11/1983 | Hubbard | 24/129 C |
| 4,617,775 | * | 10/1986 | Padrun | 24/545 |
| 4,910,362 | | 3/1990 | Kinner | 174/135 |
| 5,024,402 | | 6/1991 | Hamel | 248/52 |
| 5,040,903 | * | 8/1991 | Schramer | 283/70 |
| 5,093,964 | * | 3/1992 | Rowland | 24/17 AP |
| 5,555,607 | | 9/1996 | Parveris | 24/129 R |

FOREIGN PATENT DOCUMENTS

| | | | | |
|---|---|---|---|---|
| 0016005 | * | 1/1898 | (CH) | 24/563 |

* cited by examiner

*Primary Examiner*—Victor N. Sakran
(74) *Attorney, Agent, or Firm*—William R. Sharp

(57) ABSTRACT

A clip is disclosed herein which is composed of a resilient material and comprises a body having the following elements as in a relaxed state: opposing first and second ends, of which the first end is open to define a first slot, and the second end is closed; a first aperture adjacent to and communicating with the first slot, the first slot having a width less than the diameter of the first aperture; a second aperture adjacent to the second end; and a second slot extending between and communicating with the first and second apertures, the second slot having a width less than the respective diameters of the first and second apertures. The body of the clip is capable of deformation to temporarily increase the widths of the first and second slots for (i) receiving a pair of elongated member portions (i.e. electric cord portions) in respective first and second apertures, and for (ii) removing the clip from such elongated member portions.

8 Claims, 2 Drawing Sheets

CLIP FOR HOLDING A PAIR OF ELONGATED MEMBER PORTIONS

BACKGROUND OF THE INVENTION

The invention relates to a clip for holding a pair of elongated member portions, such as two portions of an electric cord extending from a power tool.

Most typically, when a user of a power tool (i.e. a drill, rotary saw, etc.) is finished using the tool, he or she wraps the cord around a portion of the tool for storage. The cord then frequently comes unwrapped from its desired position. To avoid this problem, the user sometimes wraps the cord around the tool too tightly or will tie the cord in a knot, leading to premature wear of the cord.

SUMMARY OF THE INVENTION

It is, therefore, an object of the invention to provide a device which secures an electric cord as wrapped around a power tool in its desired position.

It is also an object of the invention that such device is simple in construction and use, and will allow easy removal from the cord for use on another tool or for some other use.

The above objects are realized by a clip composed of a resilient material and comprising a body having the following elements as in a relaxed state: opposing first and second ends, of which the first end is open to define a first slot having a width, and the second end is closed; a first aperture having a diameter and being adjacent to and communicating with the first slot, the first slot having a width less than the diameter of the first aperture; a second aperture having a diameter and being adjacent to the second end; and a second slot extending between and communicating with the first and second apertures, the second slot having a width less than the respective diameters of the first and second apertures; whereby the body of the clip is capable of deformation to temporarily increase the widths of the first and second slots for (i) receiving a pair of elongated member portions in respective first and second apertures, and for (ii) removing the clip from the elongated member portions.

The clip of the invention is, of course, applicable to use with an electric cord (a type of "elongated member") as wrapped around a power tool. Portions of the cord are received in their respective apertures to secure the cord in place. As described hereafter, the clip preferably further comprises tabs extending from the above-mentioned first end of the body, which eases the necessary deformation of the body, particularly when removing the clip from the cord.

Although the invention is described hereafter in use with a power tool electric cord, the clip can also be used with other types of elongated members, such as hoses, tubes, pipes, ropes, etc. The clip can hold different portions of a single elongated member, or even portions of separate elongated members, in a secure relationship to one another for any useful purpose.

DETAILED DESCRIPTION OF THE INVENTION

Figure 1:
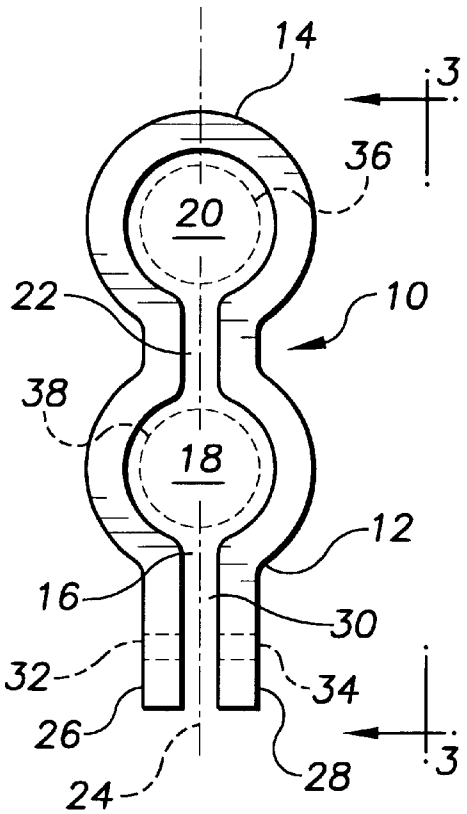
FIG. 1 is a view of a clip in its relaxed state and in accordance with one embodiment of the invention.

Referring to FIG. 1, the illustrated clip is composed of a resilient material and comprises a body 10 having the following elements as in a relaxed state: opposing ends 12 and 14, of which end 12 is open to define a slot 16, and end 14 is closed; an aperture 18 adjacent to end 12 and communicating with slot 16, which has a width less than the diameter of aperture 18; an aperture 20 adjacent to end 14; and a slot 22 extending between and communicating with apertures 18 and 20. slot 22 has a width less than the respective diameters of apertures 18 and 20. In the illustrated embodiment, and as is generally preferred, each of apertures 18 and 20 is substantially circular in shape. It is also generally preferred that the diameters of apertures 18 and 20 are substantially equivalent, and the widths of slots 16 and 22 are substantially equivalent. The clip also preferably has a longitudinal axis 24 extending through apertures 18 and 20 as well as slots 16 and 22.

Continuing to refer to FIG. 1, the illustrated clip preferably further comprises a pair of transversely spaced tabs 26 and 28 longitudinally extending from, and preferably integral with, end 12 of body 10. A space 30 as defined between the tabs communicates with slot 16 and has a width substantially equivalent to the width of slot 16. Tabs 26 and 28 of the illustrated embodiment have respective aligned holes 32 and 34 transversely extending therethrough.

Figure 2:
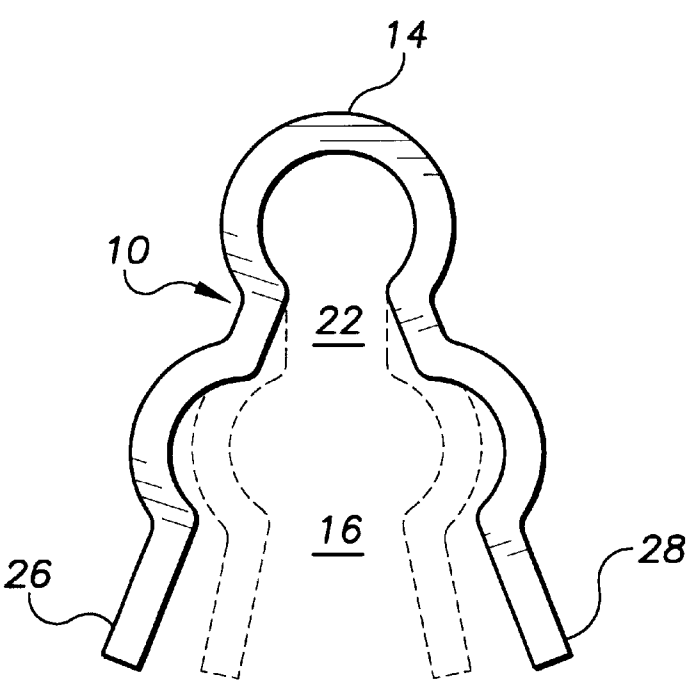
FIG. 2 shows the body of the clip as suitably deformed to receive portions of an electric cord, or to remove the clip from the cord.

Referring to FIG. 2 in conjunction with FIG. 1, body 10 of the clip is capable of deformation to temporarily increase the widths of slots 16 and 22 for (i) receiving a pair of cord portions in respective apertures 18 and 20, and for (ii) removing the clip from such cord portions. Assuming the cord has a diameter only slightly less than (i.e. 1/16 inch) the diameter of each aperture in the relaxed state (i.e. 3/8 inch) and each slot has a width of about 1/8 inch in the relaxed state, solid lines in FIG. 2 indicate the necessary deformed state for receiving a first cord portion through widened slot 22 into aperture 20, and the broken lines in FIG. 2 indicate the necessary deformed state for receiving a second cord portion through widened slot 16 and into aperture 18. FIG. 1 indicates in broken lines the positions of such cord portions at 36 and 38, as they would be received in their respective apertures after body 10 has returned to its relaxed state. This can usually be accomplished in one simple motion by grasping body 10 at or near end 14, and pushing the clip in a first direction over the cord portions to deform body 10 as described above. If necessary, however, the user can pry tabs 26 and 28 apart to assist in achieving the necessary deformation. when removing the clip from the cord portions, it is most convenient to pry tabs 26 and 28 apart and then push the clip in a second direction, opposite the above-mentioned first direction, such that the cord portions are received through the widened slots and out of their apertures.

Figure 3:
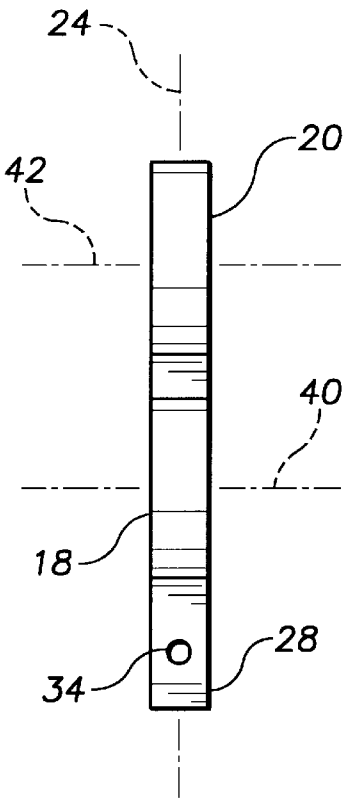
FIG. 3 is a view of the clip as viewed along line 3—3 in FIG. 1.

Referring to FIG. 3, this side view of the clip shows longitudinal axis 24, and also central axes 40 and 42 of apertures 18 and 20, respectively. Although apertures 18 and 20 are not actually visible in FIG. 3, their positions are indicated. central axes 40 and 42 are substantially perpendicular to longitudinal axis 24. FIG. 3 also shows hole 34 in tab 28.

With regard to the resilient material of the clip, such material preferably comprises a moldable plastic, such as polyethylene, which is sufficiently rigid to hold its shape in its relaxed state when holding a pair of cord portions in their respective apertures.

Figure 4:
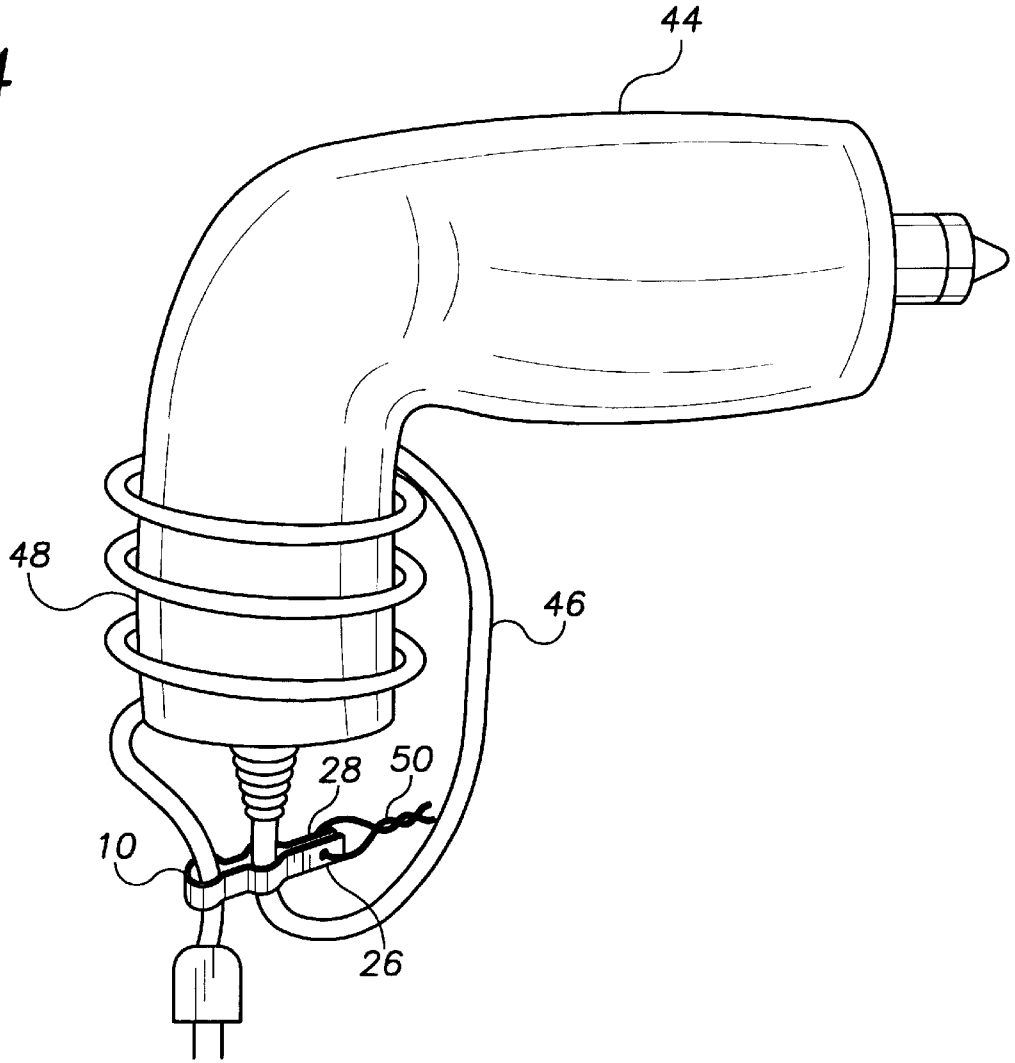
FIG. 4 shows the electric cord of a drill wrapped around its handle with the clip received over adjacent portions of the cord to secure the wrapped cord in place.

Referring to FIG. 4, a drill 44 is shown as having an electric cord 46 extending from the bottom of a handle 48.

Cord 46 is wrapped around handle 48 in the usual manner. To prevent unwrapping of cord 46, the clip of the invention has adjacent portions of the cord received through respective apertures of body 10. To further secure the clip in position and prevent inadvertent removal, a twist tie 50 is received through the holes of tabs 26 and 28 and its ends are twisted together in the typical manner. Twist tie 50 can be of the type used to close and secure the open ends of trash bags. Accordingly, twist tie 50 connects tabs 26 and 28. Other means for connecting the tabs could be employed, such as a zip tie, a bolt and nut, etc. of course, twist tie 50 can be untwisted and removed from the holes of tabs 26 and 28, and the clip easily removed from the cord in the manner described above.

Obviously, many modifications and variations of the present invention are possible in light of the above teachings. For example, a means for connecting the tabs is not necessarily required for effective use of the clip. Therefore, it is within the scope of the invention to entirely eliminate the holes in the tabs. It is, therefore, to be understood that within the scope of the appended claims, the invention can be practiced otherwise than as specifically described.

That which is claimed is:

1. An integrally formed clip composed of a resilient material and comprising:

a body having the following elements as in a relaxed state—(i) opposing first and second ends, of which the first end is open to define a first slot having a width, and the second end is closed, (ii) a first aperture having a diameter and being adjacent to and communicating with the first slot, the first slot having a width less than the diameter of the first aperture, (iii) a second aperture having a diameter and being adjacent to the second end, (iv) a second slot extending between and communicating with the first and second apertures, the second slot having a width less than the respective diameters of the first and second apertures, and (v) a longitudinal axis extending through the first and second apertures as well as the first and second slots; and a pair of transversely spaced tabs longitudinally extending from the first end of the body so as to define a space therebetween communicating with the first slot and having a width substantially equivalent to the width of the first slot, the pair of tabs terminating in transversely opposing and closely adjacent free ends;

whereby the body of the clip is capable of deformation by prying the tabs apart to temporarily increase the widths of the first and second slots for receiving a pair of elongated member portions in respective first and second apertures, and for removing the clip from such elongated member portions.

2. A clip as recited in claim 1 wherein the first and second apertures have substantially parallel central axes which are substantially perpendicular to the longitudinal axis.

3. A clip as recited in claim 2 wherein each of the first and second apertures is substantially circular in shape.

4. A clip as recited in claim 3 wherein the diameters of the first and second apertures are substantially equivalent, and the widths of the first and second slots are substantially equivalent.

5. A clip as recited in claim 4 wherein the pair of tabs have respective aligned holes transversely extending therethrough.

6. A clip as recited in claim 5 further comprising a connecting means for being received through the pair of holes so as to removably connect the pair of tabs.

7. A clip as recited in claim 6 wherein the connector means comprises a twist tie.

8. A clip as recited in claim 1 wherein the resilient material comprises a plastic.

* * * * *